US007063220B2

(12) United States Patent
Jackson

(10) Patent No.: US 7,063,220 B2
(45) Date of Patent: Jun. 20, 2006

(54) COLLAPSIBLE CLOTHESLINE

(76) Inventor: Angela W. Jackson, 8299 Cambridge #1602, Houston, TX (US) 77054

( * ) Notice: Subject to any disclaimer, the term of this patent is extended or adjusted under 35 U.S.C. 154(b) by 0 days.

(21) Appl. No.: 09/897,270

(22) Filed: Jul. 3, 2001

(65) Prior Publication Data

US 2003/0006206 A1 Jan. 9, 2003

(51) Int. Cl.
*A47G 29/087* (2006.01)

(52) U.S. Cl. ..... 211/119.01; 211/195; 211/200

(58) Field of Classification Search ..... 211/119.01, 211/195, 200; 280/79.3; D32/58
See application file for complete search history.

(56) References Cited

U.S. PATENT DOCUMENTS

| | | | | | |
|---|---|---|---|---|---|
| 482,269 | A | * | 9/1892 | North | 211/202 |
| 710,790 | A | * | 10/1902 | Magerhans | 211/200 |
| 1,462,615 | A | * | 7/1923 | Noble | 211/200 |
| 1,692,704 | A | * | 11/1928 | Rohrig | 211/200 |
| 1,724,385 | A | * | 8/1929 | Weston | 211/130.1 |
| 1,754,974 | A | * | 4/1930 | Warfield | 27/13 |
| 1,956,261 | A | * | 4/1934 | Wagner | 211/130.1 |
| 1,961,394 | A | * | 6/1934 | Rothe | 211/130.1 |
| 2,084,854 | A | * | 6/1937 | McCarthy | 108/31 |
| 2,473,047 | A | * | 6/1949 | Bershad | 211/189 |
| 2,479,887 | A | * | 8/1949 | Wolcott | 211/200 |
| 2,594,158 | A | * | 4/1952 | Hannameyer | 108/31 |
| 2,624,469 | A | * | 1/1953 | Cadwell et al. | 108/116 |
| 2,805,905 | A | * | 9/1957 | Levitan et al. | 108/145 |
| 2,927,702 | A | * | 3/1960 | Van Deusen, Jr. et al. | 108/96 |
| 3,675,338 | A | * | 7/1972 | Maki | 34/239 |
| 3,945,599 | A | * | 3/1976 | Spier et al. | 248/298.1 |
| 4,249,749 | A | * | 2/1981 | Collier | 108/145 |
| 4,297,795 | A | * | 11/1981 | Licari | 211/198 |
| 4,682,424 | A | * | 7/1987 | Irving | 211/123 |
| 4,700,847 | A | * | 10/1987 | Shieh | 206/763 |
| 4,799,744 | A | * | 1/1989 | Toy | 211/184 |
| 4,807,766 | A | * | 2/1989 | Compagnucci | 211/198 |
| 4,884,499 | A | * | 12/1989 | Rensch et al. | 126/9 R |
| 5,002,293 | A | * | 3/1991 | Gottselig | 108/145 |
| D322,698 | S | * | 12/1991 | Cassel | D32/58 |
| 5,160,153 | A | * | 11/1992 | Zan | 280/43.1 |
| 5,285,906 | A | * | 2/1994 | Wisnowski et al. | 211/62 |
| 5,372,266 | A | * | 12/1994 | Fisher | 211/119.01 |
| 5,555,640 | A | * | 9/1996 | Ou | 211/133.6 |
| 5,595,545 | A | * | 1/1997 | O'Brien | 473/259 |
| 5,755,040 | A | * | 5/1998 | Ou | 34/202 |
| 6,105,797 | A | * | 8/2000 | Haisma | 211/130.1 |
| 6,298,564 | B1 | * | 10/2001 | Voser et al. | 30/506 |

* cited by examiner

*Primary Examiner*—Lanna Mai
(74) *Attorney, Agent, or Firm*—Kenneth D. Baugh

(57) ABSTRACT

A collapsible clothesline apparatus 10 is disclosed which includes a base member 12. The base member 12 is provided with a plurality of wheels 18 coupled thereto for moving the base member 12 from one location to another. Additionally the base member 12 includes a plurality of apertures 14 formed therein which allows excess water to flow to a removable drip pan 16. The apparatus 10 also includes pole members 20, 22, 24 and 26 supported between the base member 12 and a clothes supporting member 52. The pole members 20, 22, 24 and 26 are provided to allow the clothes supporting member to be raised to a predetermined upright position and be lowered to a folded position as desired.

1 Claim, 3 Drawing Sheets

COLLAPSIBLE CLOTHESLINE

TECHNICAL FIELD

The present invention relates to a clothesline, and more particularly to a collapsible portable clothesline which is movable and can easily be stored away when not in use. Even though we live in an era of cloth dryers either in the home or in laundry mats, a lot of people still prefer the old fashion method of drying their clothes on a clothesline. This method allows ones clothes to dry while getting the fresh air smell. It is also cost effective in that it eliminates the high energy consumption associated with the use of an electric or gas clothes dryer. Even though hanging ones clothes on a clothesline is still very popular, there is still a problem in that a lot of people live in apartments or townhouses where there is limited space. This means they can not put up permanent clotheslines. There are also deed restrictions in some neighborhoods which prevent one from hanging permanent clotheslines. Because of these limitations, there exist a need for a clothesline that is readily available and can easily be store away when not in use.

BACKGROUND ART

There are several collapsible clotheslines in existence today. One such clothesline is in U.S. Pat. No. 4,735,326. This is a clothes drying apparatus with a central post member, a collar member axially displacably mounted on the supporting post member and a plurality of support arms. The supporting arms have a plurality of clothesline portions which extend between them.

Another clothesline apparatus is found in U.S. Pat. No. 5,240,128. This apparatus is an air and drying frame which consists of a vertical mast and a plurality of arms pivotably mounted to the mast for holding clothes. The apparatus also includes a retraction device for retracting the clothesline into the arms when the frame is closed.

While both of these clothesline apparatuses are collapsible and space saving, neither of them are portable and can be store away when not n use.

DISCLOSURE OF THE INVENTION

A collapsible clothesline apparatus is provided. The collapsible clothesline apparatus includes a base member having a plurality of apertures formed therein. Means are coupled to the base member at predetermined portions thereof for allowing the base member to be movable. The collapsible clothesline apparatus also includes a means slidably mounted in the base member for catching and retaining excess water which may flow through the apertures in the base member. Additionally, the clothesline apparatus is provided with means for supporting clothes to be dried thereon. The clothesline apparatus is also provided with a means for coupling the clothes supporting means to the base member and for raising the clothes supporting means to a predetermined upright position when in use and for lowering the clothes supporting means to a folded position when not in use. A means is also provided for selectively locking the clothes supporting means in upright and folded positions when desired.

BRIEF DESCRIPTION OF THE DRAWING

The details of the invention will be described in connection with accompanying drawing in which.

BEST MODE FOR CARRYING OUT THE INVENTION

Figure 1:
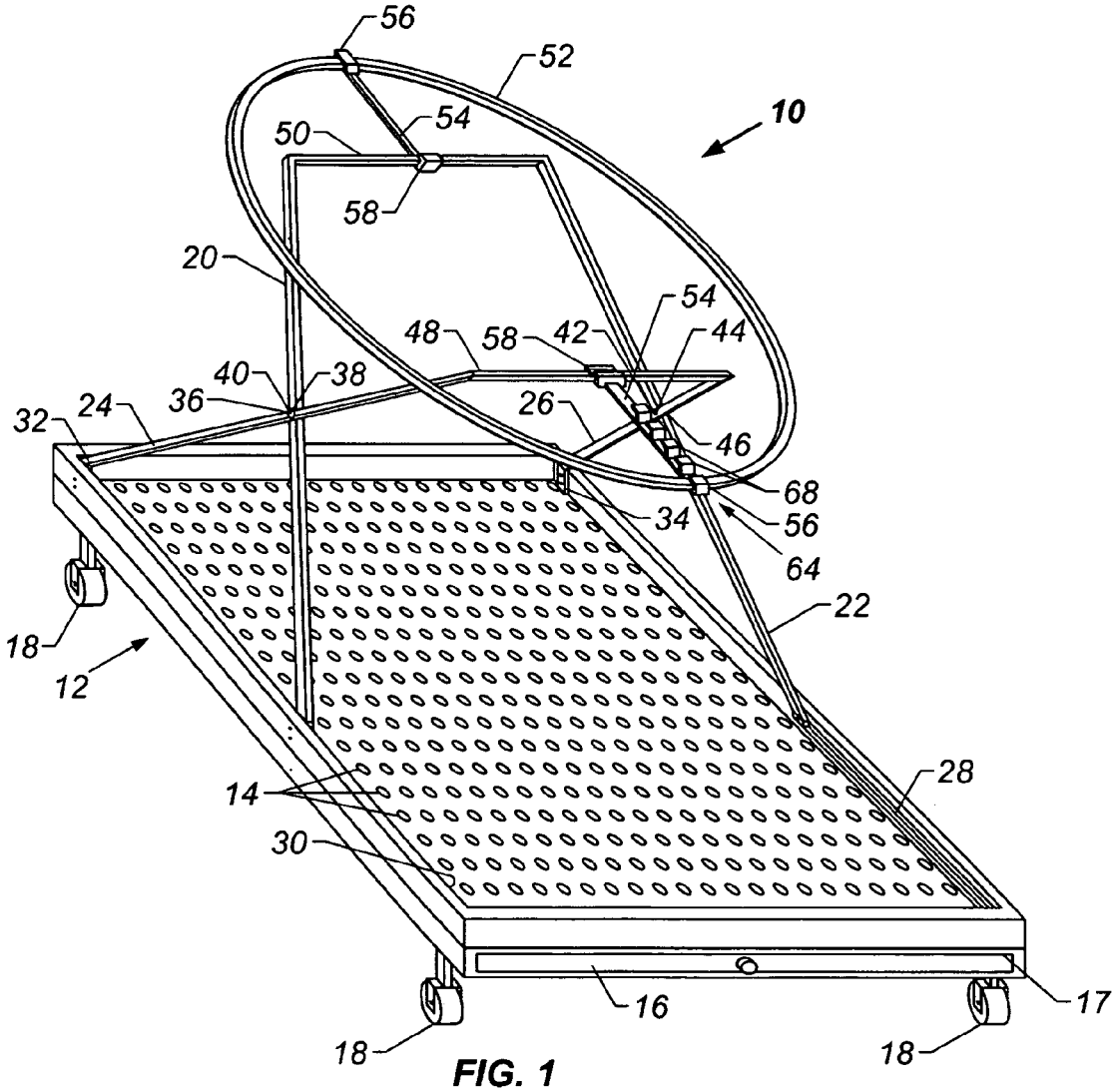
FIG. 1 is a perspective view of the collapsible clothesline apparatus in an upright position in accordance with the principles of the invention.
Figure 2:
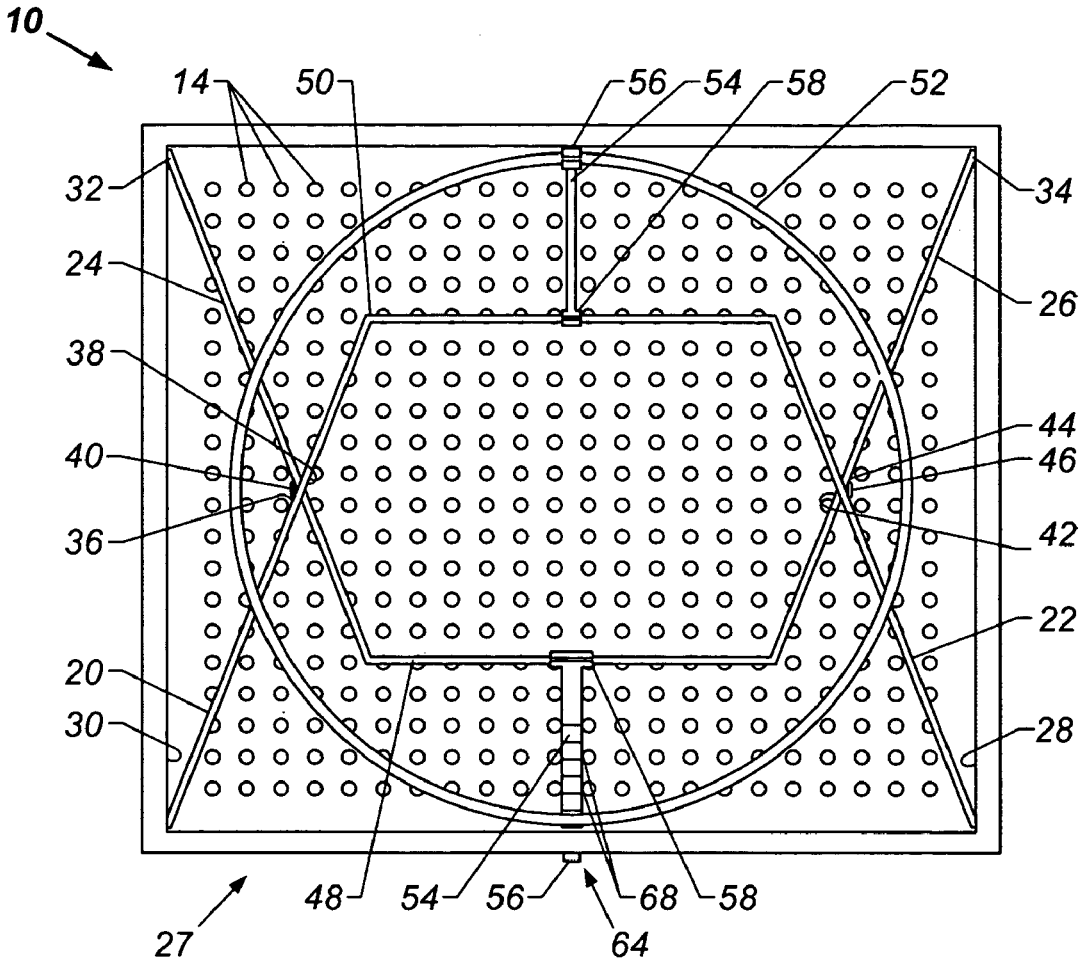
FIG. 2 is a top view of the collapsible clothesline apparatus in a folded position in accordance with the principles of the invention.
Figure 3:
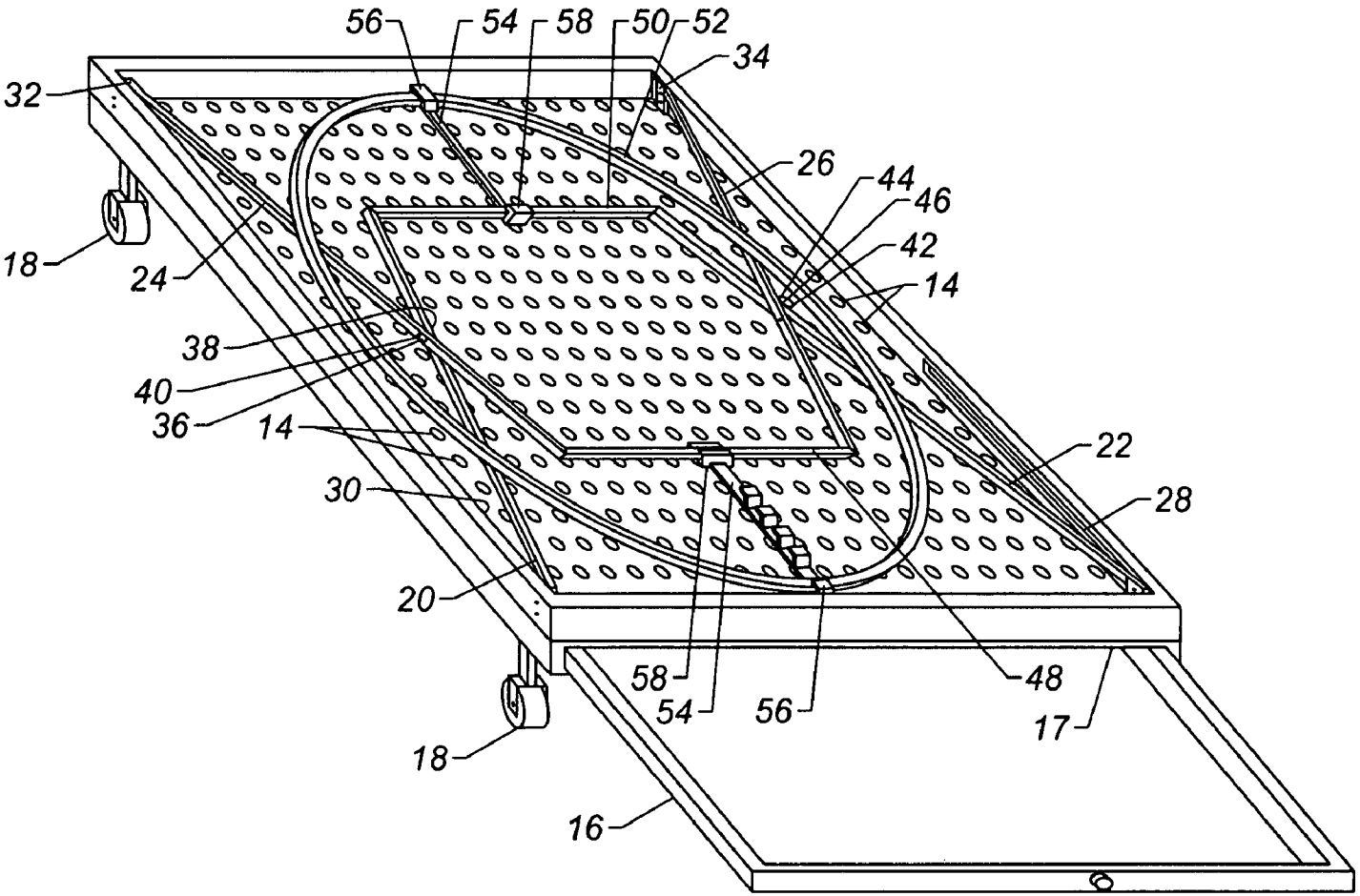
FIG. 3 is a perspective view of the collapsible clothesline apparatus in a folded position with a removable drip pan partially pulled out in accordance with the principles of the invention.

Referring to FIGS. 1, 2 and 3 there is shown a collapsible clothesline apparatus, generally designated by the numeral 10. The collapsible clothesline apparatus 10 is provided with a base member, generally designated, by the numeral 12. The base member 12 has a plurality of apertures 14 formed therein. The base member 12 also includes a drip pan 16 (FIG. 3) for catching excess water which flows through the apertures 14 in the base member 12. Excess water may, for example drip from wet clothes (not shown) that may be hung on the clothesline 10. The drip pan 16 is slidably mounted in the base member 12 in a rectangular opening 17 which extends the length thereof The pan 16 can be removed when desired so that any excess water collected therein can be removed.

The base member 12 is also provided with a plurality of wheels 18 coupled under the base member 12 to outermost portions thereof The wheels 18 allows the base member and thus the clothesline apparatus 10 to be moved as desired. The apparatus 10 is also provided with elongated arms or poles 20, 22, 24 and 26. Pole members 20 and 24 and 22 and 26 are diagonally coupled to the base member 12 at lowermost portions thereof The pole members 20 and 22 are slidably coupled to the base member 12 at one end thereof in slots 28 and 30 respectively. The pole members 24 and 26 are pivotably coupled in the base member 12 at another end thereof in slots 32 and 34 respectively. The slots 28 and 30 are horizontally extending so that the pole members 20 and 22 can be moved to a predetermined distance therein to an upright or lowered position as desired. The slots 32 and 34 are circular slots which allow the pole members 24 and 26 to pivot therein so that the pole members can be pivoted to an upright or lowered position as desired. The pole members 20 and 24 are pivotably coupled together through apertures 36 and 38 formed in the pole members by a fastening means 40 (FIG. 3). The pole members 22 and 26 are pivotably coupled together through apertures 42 and 44 formed in the pole members by a fastening means 46 (FIG. 3). The fastening members 40 and 46, may be, for example a rivet. The apertures 36, 38, 42 and 44 are slightly larger than the fastening means 40 and 46 to allow the pole members 20, 22, 24 and 26 to pivot.

A ring support arm 48 is coupled between uppermost portions of pole members 20 and 22, and a ring support arm 50 is coupled between uppermost portions of pole members 24 and 26.

The collapsible clothesline apparatus 10 also includes a circular ring member 52. The ring member 52 is provided for supporting clothes to be dried thereon. The ring member 52 is coupled to the ring support arms 48 and 50 by elongated support members 54. The elongated support members 54 are coupled to the ring member 52 by clamp members 56 and 58 coupled to the ring support arms 48 and 50 respectively.

One of the elongated support members 54 includes a locking member, generally designated, by the numeral 64 formed thereon. The locking member 64 includes spaced aligned slotted members 68 for lockingly engaging the ring member 52. The locking member 64 allows the ring member 52 to be positioned at predetermined desired heights by locking the ring member in a predetermined slotted member 68.

When it is desired to use the clothesline apparatus 10, a user may pull the ring member 52 upwardly until the pole members 20 and 22 are locked in place in the slots 28 and 30 respectively. This causes the pole members 20, 22, 24 and 26 to be locked in place in the slots 28, 30, 32 and 34 in an upright position. Clothes can then be hung around the ring member 52 as desired and allowed to remain there until dry. Any excess water from the clothes will flow through the apertures 14 into the drip pan 16. Once the clothes are dry the drip pan 16 can be removed and emptied of any excess water that may have dripped through the apertures 14 into the pan.

When the clothesline apparatus 10 is not in use a user may push the ring member 52 downwardly until the pole members 20 and 22 are locked in place in the outermost portions of slots 28 and 30 respectively. This causes the pole members 20, 22, 24 and 26 to move downwardly into a folded position. The clothesline apparatus 10 can then be moved and stored as desired.

Although in the preferred embodiment the base member 12 of the collapsible clothesline apparatus 10 is illustrated as rectangular in shape, it may also be circular in design without departing from the spirit and scope of this invention.

The size of the ring member 52 relative to the base member 12 is such that any water from the wet clothes would drip only into the pan 16. Thus the size (circumference) of the ring may vary without departing from the spirit and scope of this invention. Additionally, the ring member 52 may be formed with hooks for hanging the wet clothes thereon without departing from the spirit and scope of this invention.

It should be understood that various changes and modifications can be made without departing from the spirit of the invention as defined in the claim.

What is claimed is:

1. A collapsible clothesline apparatus which includes:

a base member having a plurality of apertures formed therethrough;

a plurality of wheels coupled to lowermost portions of the base member for allowing the base member to be moved from one location to another;

a drip pan slidably mounted in the base member for catching and retaining excess water which flows through the apertures in the base member;

a ring member for supporting clothes thereon;

a pair of pivotably coupled diagonally intersecting pole members coupled to the ring member at upper portions of the diagonally intersecting pole members so that the ring member is coupled to the base member, and so that the ring member can be raised to a predetermined upright position and lowered to a folded position; and a plurality of spaced aligned slotted members for selectively lockingly engaging predetermined portions of the ring member to lock the ring member in the upright position when in use and in the folded position when not in use and for selectively lockingly engaging predetermined portions of the ring member so that the ring member can be adjusted to a predetermined desired height.

* * * * *